US008083397B2

(12) United States Patent
Pappalardo

(10) Patent No.: US 8,083,397 B2
(45) Date of Patent: Dec. 27, 2011

(54) STATIC MIXER

(75) Inventor: Matthew E. Pappalardo, Ewing, NJ (US)

(73) Assignee: Nordson Corporation, Westlake, OH (US)

( * ) Notice: Subject to any disclaimer, the term of this patent is extended or adjusted under 35 U.S.C. 154(b) by 337 days.

(21) Appl. No.: 12/474,494

(22) Filed: May 29, 2009

(65) Prior Publication Data

US 2009/0310437 A1 Dec. 17, 2009

Related U.S. Application Data

(60) Provisional application No. 61/061,424, filed on Jun. 13, 2008.

(51) Int. Cl.
*B01F 5/06* (2006.01)

(52) U.S. Cl. ..... 366/337

(58) Field of Classification Search ..... 366/336, 366/337, 340

See application file for complete search history.

(56) References Cited

U.S. PATENT DOCUMENTS

| | | | | |
|---|---|---|---|---|
| 3,195,865 | A * | 7/1965 | Harder | 366/337 |
| 3,239,197 | A | 3/1966 | Tollar | |
| 3,643,927 | A * | 2/1972 | Crouch | 366/337 |
| 3,944,055 | A | 3/1976 | Stumpf | |
| 5,944,419 | A | 8/1999 | Streiff | |
| 6,599,008 | B2 | 7/2003 | Heusser et al. | |
| 6,773,156 | B2 | 8/2004 | Henning | |
| 7,325,970 | B2 | 2/2008 | Keller | |
| 2001/0015936 | A1 * | 8/2001 | Heusser et al. | 366/337 |
| 2003/0048694 | A1 | 3/2003 | Horner et al. | |
| 2004/0008576 | A1 * | 1/2004 | Henning | 366/337 |
| 2006/0245299 | A1 | 11/2006 | Heusser et al. | |
| 2008/0083782 | A1 | 4/2008 | Heusser et al. | |

FOREIGN PATENT DOCUMENTS

| | | | |
|---|---|---|---|
| DE | 10322922 | A1 | 12/2004 |
| EP | 0749776 | A1 | 12/1996 |
| EP | 0815929 | A1 | 1/1998 |
| JP | 55145522 | A | 11/1980 |
| WO | 2004/004875 | A2 | 1/2004 |

OTHER PUBLICATIONS

European Patent Office, European Search Report in EP Application No. 09162618, Oct. 14, 2009.

* cited by examiner

*Primary Examiner* — David Sorkin

(74) *Attorney, Agent, or Firm* — Wood, Herron & Evans, L.L.P.

(57) ABSTRACT

A mixer for mixing at least first and second fluids comprises a conduit configured to receive a stream of the first and second fluids. A first series of mixing elements are disposed within the conduit and configured to divide the stream in a first direction. A second series of mixing elements are disposed within the conduit and configured to divide the stream in a second direction different from the first direction. The mixing elements of the first series each comprises a first planar member oriented in the first direction and defining a leading edge, a second planar member oriented in the second direction and defining a trailing edge, a first deflecting surface extending outwardly from a first side of the first planar member and configured to direct fluid flow to a space adjacent a first side of the second planar member, and a second deflecting surface extending outwardly from a second side of the first planar member and configured to direct fluid flow to a space adjacent a second side of the second planar member.

22 Claims, 5 Drawing Sheets

STATIC MIXER

CROSS-REFERENCE TO RELATED APPLICATIONS

This application claims the benefit of U.S. Provisional Application No. 61/061,424, filed Jun. 13, 2008, the disclosure of which is hereby incorporated by reference herein in its entirety.

TECHNICAL FIELD

The present invention relates generally to a device for mixing two or more fluids together, and more particularly to a static mixer having mixing elements that divide a fluid stream in different directions and/or a static mixer having mixing elements that do not require orientation during assembly of the mixer.

BACKGROUND

Many applications require two or more fluids to be mixed together. For example, two-component adhesives and sealants include a base component and activator component that must be mixed together prior to use. This mixing can be accomplished by forcing each component into and through a motionless (i.e., static) mixer. Such mixers include a mixing component or assembly disposed within a conduit, with the mixing component having a series of interconnected mixing elements in the form of baffles, spirals, wedges, and/or deflection plates. The mixing elements divide and recombine the fluids in an overlapping manner to produce layers of the fluids. Eventually this division and recombination causes the layers to thin and diffuse past one another, resulting in a substantially uniform mixture.

The mixing elements comprised of baffles in conventional static multiflux mixers, examples of which are shown in U.S. Pat. Nos. 6,773,156 and 3,239,197, and plate multiflux mixers, an example of which is shown in U.S. Pat. No. 5,944,419, are oriented in one specific longitudinal direction (relative to the conduit of the mixer) and configured to divide the fluid stream in the same transversal direction (e.g., an X or Y direction). Such an arrangement is desirable because alternating the dividing direction may defeat the purpose of the mixing elements. In particular, when a mixing element that divides in an X-direction and recombines in a Y-direction is immediately followed by a mixing element that divides Y-direction and recombines in the X-direction, the mixing accomplished by the first mixing element may be effectively "undone" by the second mixing element.

One of the challenges associated with the conventional mixing arrangement described above is the elimination of streaks in the extruded mixture. For example, when mixing together fluids of different viscosities, there is a tendency for the low viscosity fluid to channel or "zig-zag" along the interior walls of the conduit instead of being properly included in the layering process. This results in a streak of the unmixed fluid within the extruded mixture dispensed from the static mixer. Such streaks are undesirable for a variety of reasons. They may affect the performance of the product or they may cause the operator of the static mixer to question whether it has effectively mixed the two components or fluids of the adhesive or sealant in cases where the streak does not affect performance.

Several attempts have been made to eliminate streaking by incorporating various additional mixing features, such as webs, varying baffle sizes, and varying baffle geometries, in the series of interconnected mixing elements. However, current technologies leave room for improvement when mixing difficult materials. Streaks still occur with certain materials, requiring the end user to use longer mixers, which are disadvantageous for many reasons. Longer mixers are less manageable to use and generally have a higher retained volume, wasting more fluid when the mixer is disposed. Many elements are designed to be oriented in a specific longitudinal direction when inserted into the conduit of the mixer. Thus, for the fluids to move through the specially designed geometry in the proper direction, the manufacturer must properly orient the mixing elements during assembly of the mixer. Orienting the mixer during assembly adds cost, time, and complexity to the manufacturing process. Many manufactures provide orientation tabs or other structure on the component to ensure that it is inserted into the conduit in the proper direction.

Therefore, a mixer that reduces streaking and/or does not require an orientation step during assembly is highly desirable.

SUMMARY

The present invention generally provides a mixer for mixing at least first and second fluids. The mixer includes a conduit configured to receive a stream of the first and second fluids, and a mixing component positioned within the conduit. The mixing component generally comprises a first series of mixing elements, each configured to divide the stream in a first direction and recombine the stream in a second direction. The mixing component further includes a second series of mixing elements each configured to divide the stream in a third direction different from the first direction and recombine the stream in a fourth direction different from the second direction.

Various embodiments of the invention are provided including, for example, an embodiment in which the mixing elements of the first series each comprises a first planar member oriented in a first direction and defining a leading, stream dividing edge, a second planar member oriented in the second direction and defining a trailing, stream recombining edge, a first deflecting surface extending outwardly from a first side of the first planar member and configured to direct fluid flow to a space adjacent a first side of the second planar member, and a second deflecting surface extending outwardly from a second side of the first planar member and configured to direct fluid flow to a space adjacent a second side of the second planar member. The first and second directions may be substantially perpendicular to each other. The mixing elements of the first series may be configured to recombine the stream in the second direction and/or the mixing elements of the second series may each be configured to recombine the stream in the first direction. An auxiliary baffle may be positioned between a mixing element of the first series and a mixing of the second series and configured to redirect portions of the stream. For example, the auxiliary baffle may comprise a flow inversion baffle configured to direct portions of the stream in a center of the conduit to a periphery of the conduit and direct portions of the stream in the periphery of the conduit to the center of the conduit. A plurality of auxiliary baffles may be used throughout the mixing component in any desired sequence. The various mixing elements, including the auxiliary baffle or baffles may be interconnected in any desired manner, or formed as independent units and placed adjacent to each other and otherwise held within the conduit.

Various other features will become readily apparent upon review of the following detailed description of the illustrative embodiments.

DETAILED DESCRIPTION

Figure 1:
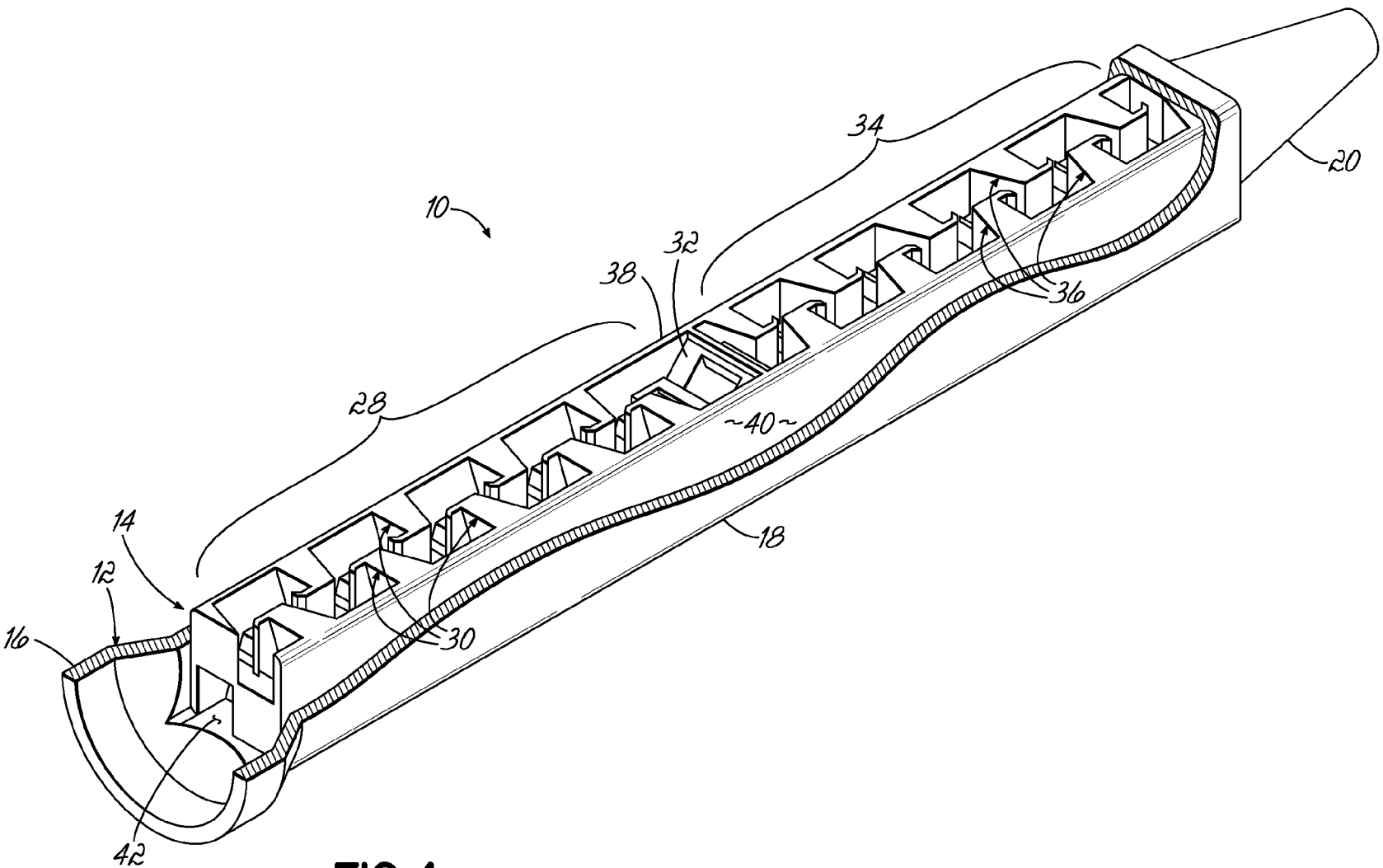
FIG. 1 is a perspective view of a mixer according to one embodiment with a portion of a conduit wall removed.

With reference to FIG. 1 one embodiment of a mixer 10 is shown. The mixer 10 generally comprises a conduit 12 and a mixing component 14 inserted into the conduit 12. The conduit 12 defines an inlet end 16 configured to be attached to a cartridge, cartridge system, or metering system (none of which are shown) containing at least two fluids to be mixed together. For example, the inlet end 16 may be connected to any of the two-component cartridge systems available from TAH Industries, Inc. The conduit 12 also includes a body section 18 shaped to receive the mixing component 14 and a nozzle outlet 20 communicating with the body section 18. Although the body section 18 and mixing component 14 are shown as having substantially square cross-sectional profiles, those skilled in the art will appreciate that the concepts described below may equally apply to mixers with other geometries.

The mixing component 14 of the embodiment shown in FIG. 1 includes a first series 28 of mixing elements or baffles 30, a flow inversion element or baffle 32, and a second series 34 of mixing elements or baffles 36, each integrally molded with and disposed between first and second sidewalls 38, 40. The first and second sidewalls 38, 40 bound opposite sides of the mixing component 14, whereas sides of the mixing component 14 between the first and second sidewalls 38, 40 remain exposed to an associated interior surface 42 of the conduit 12 (one of the interior surfaces 42 is not shown in FIG. 1). The number of baffles 30, 32, and 36, along with their respective shapes, may vary. Thus, although the structure shown in FIG. 1 will be described in considerable detail below, the mixer 10 is merely one example of an embodiment incorporating aspects of the invention.

Now referring to FIGS. 2 and 2A-2C, the first series 28 is illustrates in further detail. The first and second sidewalls 38, 40 (FIG. 1) of the mixing component 14 are not shown for clarity. The first series 28 begins with a partial baffle 30*a* and then alternates between baffles 30*b* having a first configuration and baffles 30*c* having a second configuration. The first and second configurations are similar, but reversed about at least one center plane aligned parallel to a longitudinal axis of the mixing component 14 and conduit 12 such that the baffles 30*b* and 30*c* are mirror images of each other. The baffles 30*b* having the first configuration are sometimes referred to as "right-handed" baffles, and the baffles 30*c* having the second configuration are sometimes referred to as "left-handed" baffles. Because of their similar construction, like reference numbers will be used to identify the structure of the baffles 30*a*, 30*b*, and 30*c*. Additionally, reference number 30 will be used to generically refer to the baffles 30*a*, 30*b*, and 30*c* of the first series 28 where appropriate (e.g., discussion of FIG. 1 above).

The baffles 30*b* (FIG. 2B) and 30*c* (FIG. 2C) each include a first planar member 56 oriented in a first direction, which is shown as a generally vertical direction ("Y-direction") in the illustrative embodiment, and a second planar member 58 oriented in a second direction, which is shown as a generally horizontal direction ("X-direction"). The first planar member 56 extends in a direction parallel to a longitudinal axis of the mixing component 14 and terminates in a leading edge 60 defined by first and second sections 62, 64. The first section 62 is slightly angled, or "hooked," toward a first side 66 of the first planar member 56, and the second section 64 is slightly angled, or "hooked," toward a second side 68 of the first planar member 56. The second planar member 58 has a shape similar to the first planar member 56, but defines a trailing edge 70. To this end, the trailing edge 70 likewise includes a first section 72 slightly angled toward a first side 74 of the second planar member 58 and a second section 76 slightly angled toward a second side 78 of the second planar member 58.

The baffles 30*b*, 30*c* further include first and second deflecting surfaces 84, 86 extending outwardly from the first planar member 56. The first deflecting surface 84 is configured to direct fluid downwardly toward the space adjacent the first side 74 of the second planar member 58. The second deflecting surface 86 is configured to direct fluid upwardly to the space adjacent the second side 78 of the second planar member 58.

Figure 2:
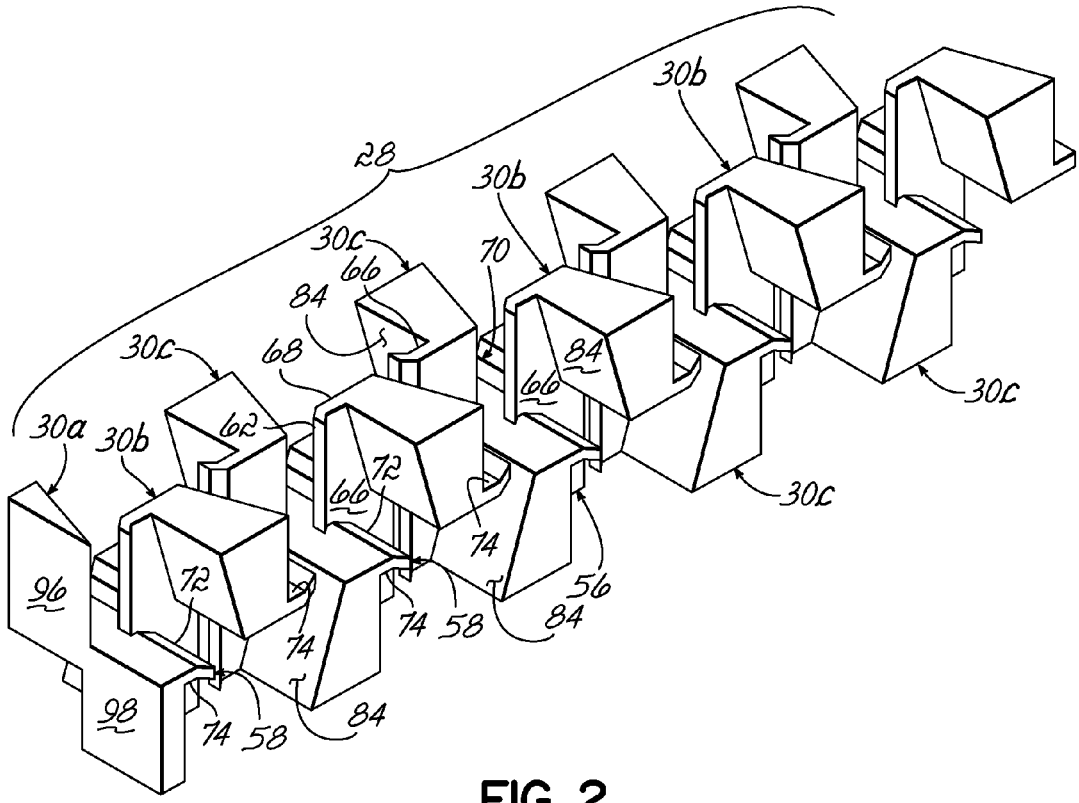
FIG. 2 is a perspective view of a first series of interconnected baffles from the mixer of FIG. 1 with leading edges oriented in a first direction.
Figure 2A:
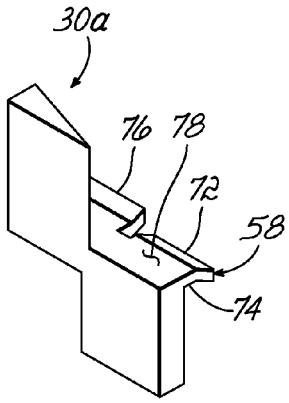
FIG. 2A is a perspective view of the first baffle in the series of FIG. 2.
Figure 2C:
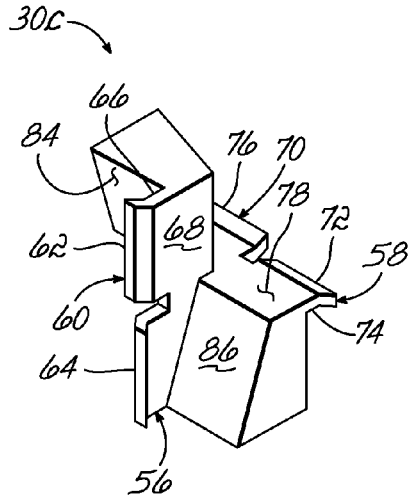
FIG. 2C is a perspective view of a baffle of FIG. 2 having a second orientation.
Figure 2B:
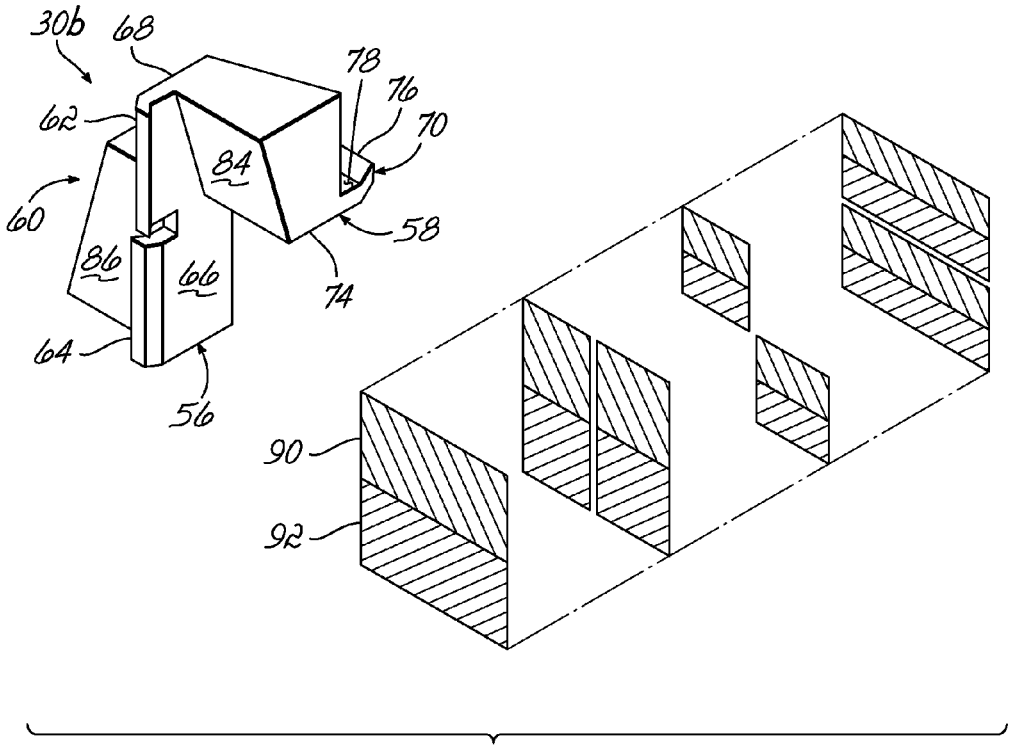
FIG. 2B is a perspective view of a baffle of FIG. 2 having a first orientation, and schematically illustrates the mixing process of the baffle.

FIG. 2B illustrates the mixing characteristics of one of the baffles 30*b*. Two unmixed fluids 90, 92 are introduced into the mixer 10. When the two fluids 90, 92 intersect the leading edge 60 of the first planar member 56, the fluid flow is divided in a generally vertical direction. The divided flows are then shifted vertically in opposite directions by the first and second deflecting surfaces 84, 86 as the fluid stream continues to flow over the baffle 30*b*. After flowing past the first planar member 56, the divided flows expand laterally across the width of the second planar member 58 and are positioned in an overlapping manner. The fluids 90, 92 are effectively "recombined" in this latter step. As can be seen, one of the baffles 30*b* doubles the number of layers of the fluids 90, 92.

The baffles 30*b* (FIG. 2B) may be interconnected with the baffles 30*c* (FIG. 2C), which operate upon the same principles because of their similar structure. Alternatively, the various baffles 30 may be independent units and simply held adjacent one another by other structure. The mixing characteristics of the baffles 30*c* are therefore clear from the description given of baffles 30*b*. The partial baffle 30*a* (FIG. 2A) also operates in a similar manner to the baffles 30*b*, but does not include the first planar member 56 or the first and second deflecting surfaces 84, 86. Instead, the partial baffle 30*a* includes first and second end surfaces 96, 98 aligned in the same plane. The first and second end surfaces 96, 98 effectively block fluid flow in opposite corners of the mixing component 14. As a result, a stream of two or more fluids must divide and shift to one of the open spaces adjacent the first and second end surfaces 96, 98 before "recombining" (i.e., extending) across the width of the second planar member 58.

Each of the baffles 30*a*, 30*b*, and 30*c* thus divide and recombine a fluid stream to double the number of layers in the fluid stream. Because the first series 28 includes a total of ten baffles, the first series 28 is capable of dividing a fluid stream of two materials into 2048 layers of alternating material (layers=2 materials$\times 2^n$, where n is the number of baffles). The presence of the partial baffle 30*a* helps reduce the overall length of the first series 28. In alternative embodiments, however, the partial baffle 30*a* may be eliminated or replaced with one of the baffles 30*c* such that the first series 28 consists only of the baffles 30*b* and 30*c*. There may also be a larger or smaller number of total baffles 30 in the first series 28 in alternative embodiments.

FIGS. 3 and 3A-3C illustrate the second series 34 of baffles 36 (FIG. 1) in further detail. Again, the first and second sidewalls 38, 40 of the mixing component 14 are not shown for clarity. The second series 34 is similar to the first series 28 in that it alternates between baffles 36*a* having a first configuration and baffles 36*b* having a second configuration, with baffles 36*a* being mirror images of the baffles 36*b*. Baffles 36*a*, 36 each include first and second planar members 110, 112 and first and second deflecting surfaces 114, 116. The baffles 36*a*, 36*b*, are similar to baffles 30*b*, 30*c* of the first embodiment but are oriented in different directions than the baffles 30*b*, 30*c*. More specifically, the first planar members 110 each define a leading edge 120 oriented in the second direction (X-direction) rather than in the first direction (Y-direction). The leading edge 120 includes a first section 122 hooked toward a first side 124 of the first planar member 110 and a second section 126 hooked toward a second side 128 of the first planar member 110. On the other hand, the second planar members 112 each define a trailing edge 132 oriented in the first direction (Y-direction) rather than in the second direction (X-direction). The trailing edge 132 includes a first section 134 hooked toward a first side 136 of the second planar member 112 and a second section 138 hooked toward a second side 140 of the second planar member 112.

Figure 3A:
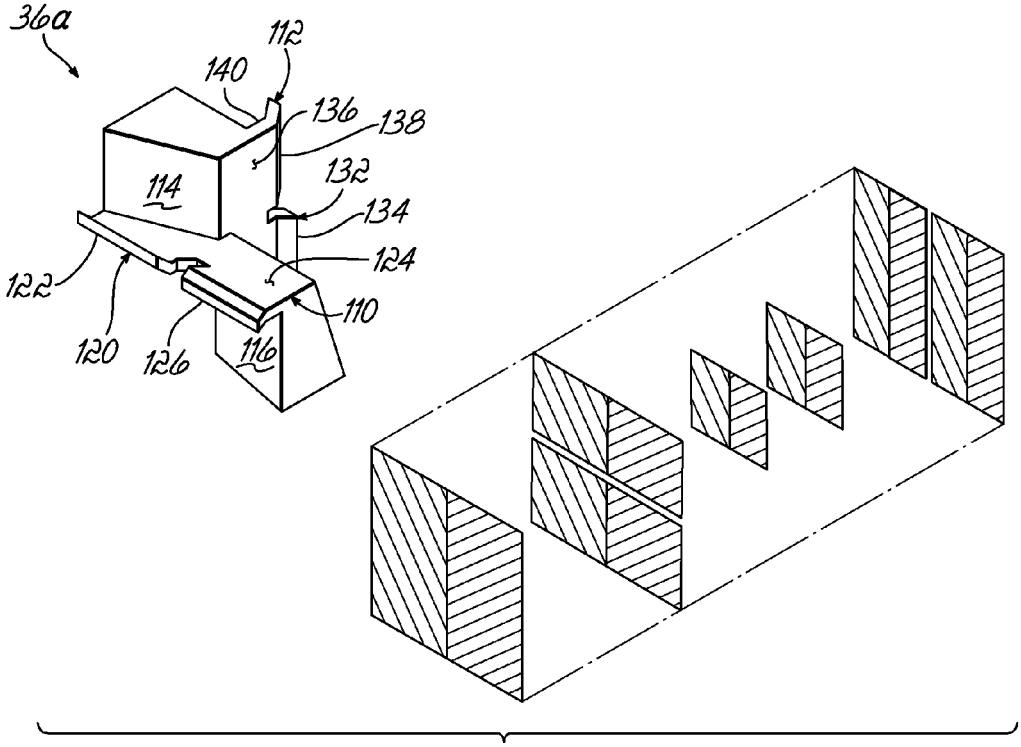
FIG. 3A is a perspective view of a baffle of FIG. 3 having a first orientation, and schematically illustrates the mixing process of the baffle.

As schematically shown in FIG. 3A, each baffle 36*a* divides fluid flow in a generally horizontal direction due to the orientation of the first planar member 110. The divided flows are then shifted laterally by the first and second deflecting surfaces 114, 116 as the fluids 90, 92 continue to flow over the baffle 36*a*. After flowing past the first planar member 110, these flows expand vertically across the second planar member 112 to effectively recombine in an overlapping manner. Thus, the baffles 36*a* operate upon the same principles as the baffles 30*b*, but divide and recombine fluid flows in opposite 900 transversal directions. The same holds true when comparing the baffles 36*b* to the baffles 30*c*.

Figure 3:
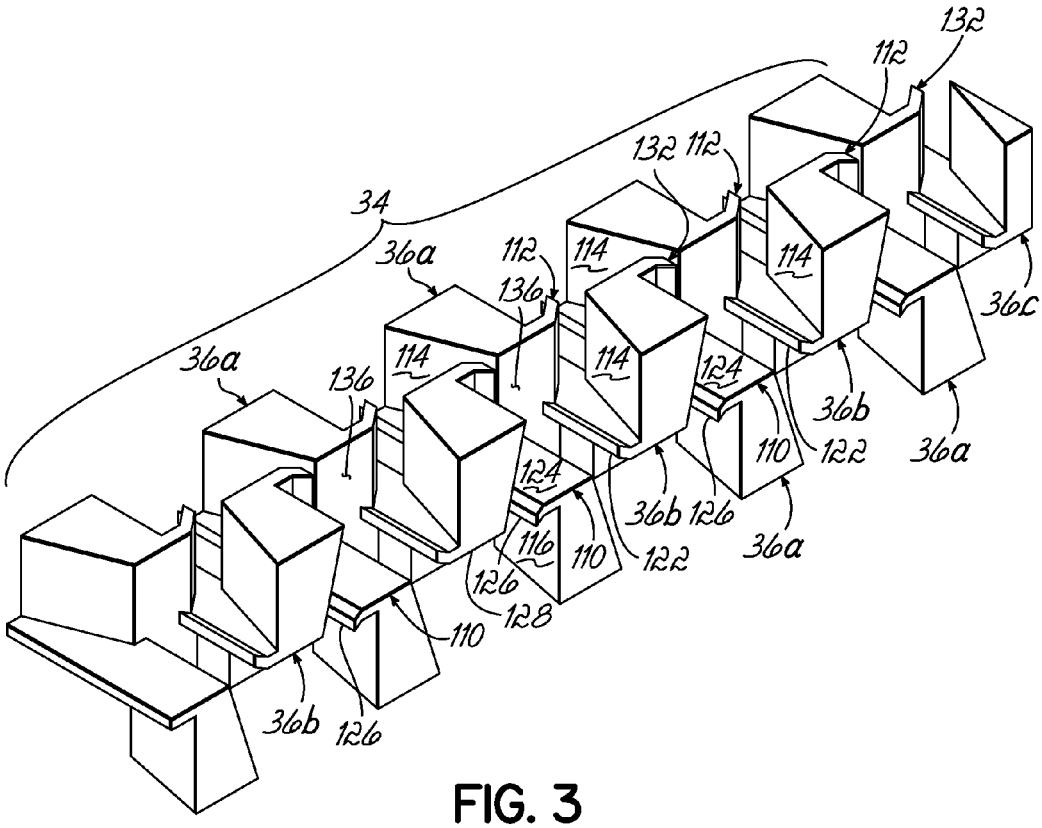
FIG. 3 is a perspective view of a second series of interconnected baffles from the mixer of FIG. 1 with leading edges oriented in a second direction.
Figure 3B:
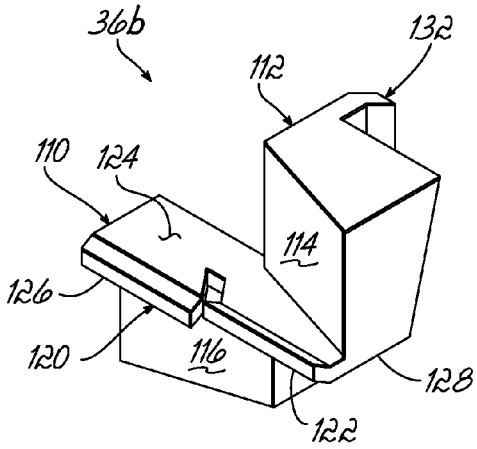
FIG. 3B is a perspective view of a baffle of FIG. 3 having a second orientation.
Figure 3C:
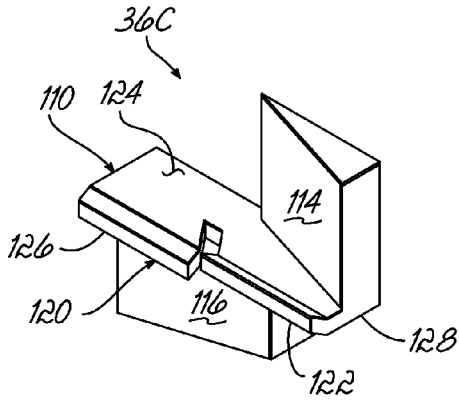
FIG. 3C is a perspective view of the last baffle in the series of FIG. 3.
Figure 4:
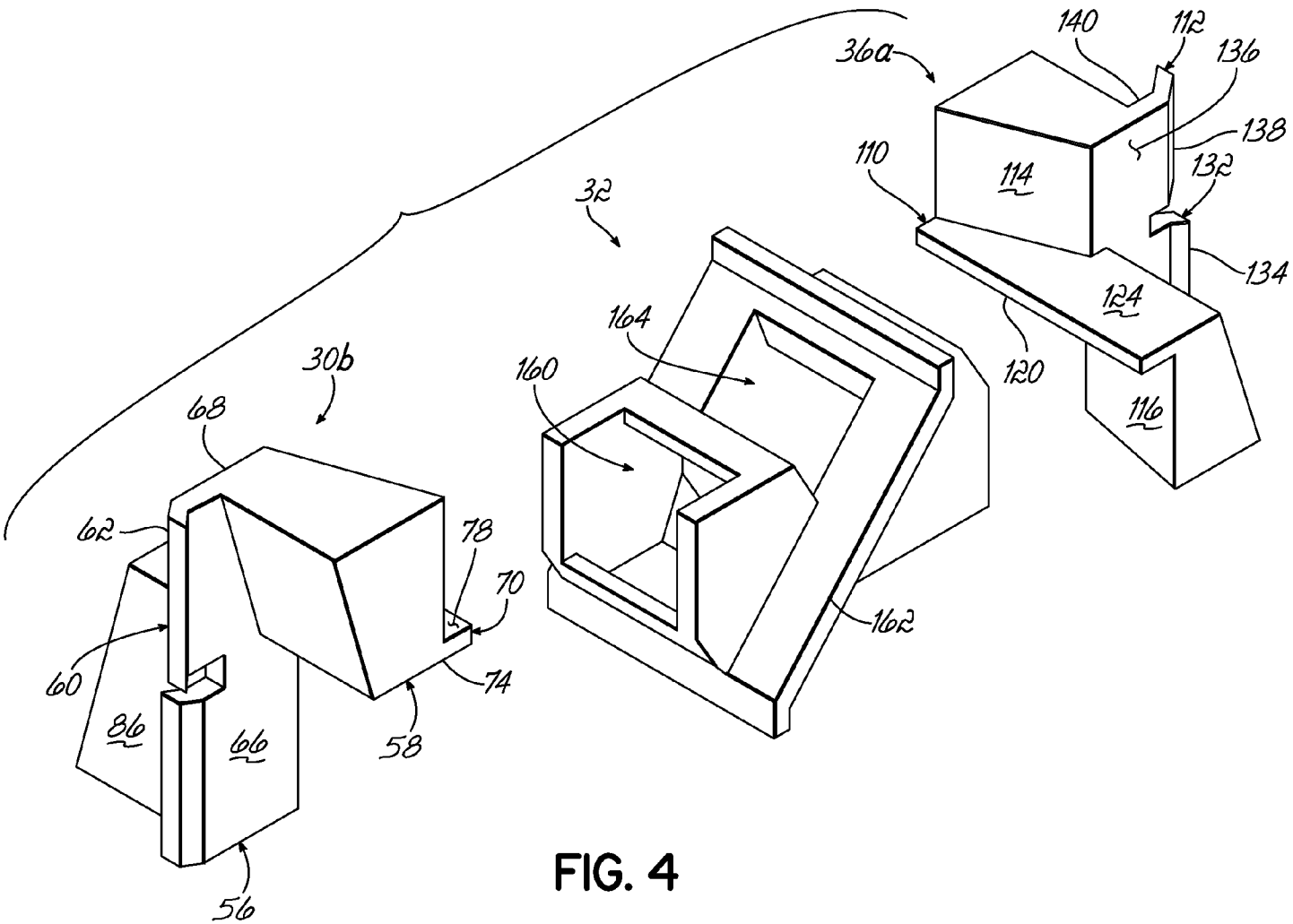
FIG. 4 is a perspective view of a flow inversion baffle positioned between the last baffle in the first series of interconnected baffles and the first baffle in the second series of interconnected baffles.

FIG. 4 schematically illustrates the flow inversion baffle 32 positioned between the last baffle 30*b* in the first series 28 (FIG. 2) and the first baffle 36*a* in the second series 34 (FIG. 3). The trailing edge 70 of the last baffle 30*b* in the first series 28 and the leading edge 120 of the first baffle 36*a* in the second series are not "hooked" to any side. The flow inversion baffle 32, along with alternative designs thereof, are shown and described in U.S. Pat. No. 6,773,156 ("the '156 patent"), the disclosure of which is fully incorporated herein by reference. As described in the '156 patent, the flow inversion baffle 32 includes a center-to-perimeter flow chamber 160, a flow diverter 162, and a perimeter-to-center flow chamber 164 that cooperate to: 1) redirect fluid from the center of conduit 12 to a periphery of the conduit 12, and 2) redirect fluid from the periphery of the conduit 12 to the center of the conduit 12. For a more detailed explanation of the structure of the flow inversion baffle 32 and how this redirection is accomplished, reference can be made to the description in the '156 patent.

Advantageously, the flow inversion baffle 32 has rotational symmetry about a center plane perpendicular to a longitudinal axis of conduit 12. Additionally, the second series 34 includes the same number of baffles as the first series 28 such that there are a total of 21 mixing elements (ten of the baffles 30, one flow inversion baffle 32, and ten of the baffles 36) in the mixer 10. Indeed, in the exemplary embodiment shown, the second series 34 is generally a mirror image of the first series 28 such that the entire mixing component 14 has rotational symmetry about the center plane. When viewing one of the open sides of the mixing component 14 (e.g., FIG. 1), the baffles 30 in the first series 28 "hook" toward the inlet end 16 of the conduit 12 and the baffles 36 in the second series 34 "hook" toward the nozzle outlet 20 of the conduit 12. The same arrangement and effect would be obtained if the mixing component 14 were inserted into the conduit 12 with a reverse orientation. Thus, the rotational symmetry of the mixing component 14 eliminates the need to orient the mixing component 14 in a particular longitudinal direction when assembling the mixer 10.

In use, two fluids introduced into the conduit 12 are divided in the first direction into layers of alternating materials by the first series 28 of baffles 30. These layers are then inverted and twisted by the flow inversion baffle 32. Any material that "channels" or "zig-zags" along the interior surfaces 42 of the conduit 12 is directed from the periphery of the flow path into the center of the flow path. Upon exiting the flow inversion baffle 32, the twisted and inverted layers are divided in the second direction by the second series 34 of baffles 36.

By dividing the fluid stream in different directions, overall mixing quality is improved. Channeling is reduced not only by the flow inversion baffle 32, but also because this undesirable side effect is more likely to occur on different sides of the mixing component 14 in the first and second series 28, 34. For example, in the first series 28, channeling may only occur along the interior surfaces 42, whereas in the second series 34, channeling may only occur along the sidewalls 38, 40 of the mixing component 14. Any channeling that occurs in the first series 28 will be mixed up by the second series 34 rather than continuing to build up along the interior surface 42.

These same advantages may be achieved in a wide variety of other mixer arrangements, as long as the mixer includes at least one mixing element or baffle configured to divide a fluid stream in a first direction and at least one mixing element or baffle configured to divide a fluid stream in a second direction different from the first direction. Therefore, the baffles 30 and 36 need not be arranged in the first and second series 28, 34. Nor do the baffles 30 and 36 have to be integrally molded as part of a unitary structure. There may also be a plurality of the flow inversion baffles 32 positioned throughout an arrangement of the baffles 30 and 36.

Thus, while the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. As a further example, the first and second directions in which the fluid stream is divided need not be substantially perpendicular X and Y directions. To this end, the first series 28 of baffles 30 and second series 34 of baffles 36 may have different geometries. Additionally, although the mixer 10 includes the flow inversion baffle 32, which is shown and described in the '156 patent, the mixer 10 may alternatively or additionally include an auxiliary baffle/relayering chamber, an example of which is shown in FIGS. 16a-e of U.S. Pat. No. 3,239,197 to Tollar ("the '197 patent"). The disclosure of the '197 patent is thus fully incorporated herein by reference.

While the present invention has been illustrated by a description of various preferred embodiments and while these embodiments have been described in some detail, it is not the intention of the Applicants to restrict or in any way limit the scope of the appended claims to such detail. Additional advantages and modifications will readily appear to those skilled in the art. The various features discussed herein may be used alone or in any combination depending on the needs and preferences of the user. This has been a description of illustrative aspects and embodiments the present invention, along with the preferred methods of practicing the present invention as currently known. However, the invention itself should only be defined by the appended claims.

What is claimed is:

1. A mixer for mixing at least first and second fluids, comprising:

a conduit configured to receive a stream of the first and second fluids; and a first series of mixing elements disposed within the conduit and configured to divide the stream in a first direction; and a second series of mixing elements disposed within the conduit and configured to divide the stream in a second direction different from the first direction;

wherein the mixing elements of the first series each comprises a first planar member oriented in the first direction and defining a leading, stream dividing edge, a second planar member oriented in the second direction and defining a trailing, stream recombining edge, a first deflecting surface extending outwardly from a first side of the first planar member and configured to direct fluid flow to a space adjacent a first side of the second planar member, and a second deflecting surface extending outwardly from a second side of the first planar member and configured to direct fluid flow to a space adjacent a second side of the second planar member.

2. The mixer of claim 1 wherein the first and second directions are substantially perpendicular to each other.

3. The mixer of claim 1 wherein the mixing elements of the first series are each configured to recombine the stream in the second direction.

4. The mixer of claim 3 wherein the mixing elements of the second series are each configured to recombine the stream in the first direction.

5. The mixer of claim 1 further comprising:

an auxiliary baffle positioned between a mixing element of the first series and a mixing element of the second series, the auxiliary baffle configured to redirect portions of the stream.

6. The mixer of claim 5, wherein the auxiliary baffle further comprises:

a flow inversion baffle configured to direct portions of the stream in a center of the conduit to a periphery of the conduit and portions of the stream in the periphery of the conduit to the center of the conduit.

7. The mixer of claim 6 further comprising:

a plurality of the flow inversion baffles.

8. The mixer of claim 1, wherein the first and second series of mixing elements are respectively configured and positioned in the conduit to form a rotational symmetric mixing component about a center plane perpendicular to a longitudinal axis of the conduit.

9. The mixer of claim 1, wherein the first series of mixing elements further comprises a partial baffle defining a first end of the mixing component, the partial baffle having first and second end surfaces aligned in a plane perpendicular to a longitudinal axis of the conduit and arranged in opposite corners of the mixing component.

10. A mixer for mixing at least first and second fluids, comprising:

a conduit configured to receive a stream of the first and second fluids; and a mixing component positioned within the conduit, the mixing component including:

a first series of mixing elements each configured to divide the stream in a first direction and recombine the stream in a second direction;

a second series of mixing elements each configured to divide the stream in a third direction different from the first direction and recombine the stream in a fourth direction different from the second direction; and an auxiliary baffle positioned between two respective mixing elements of the first and second series, the auxiliary baffle configured to direct portions of the stream from a center of the conduit to a periphery of the conduit and portions of the stream from the periphery of the conduit to the center of the conduit.

11. The mixer of claim 10 wherein the first direction is substantially perpendicular to the second direction.

12. The mixer of claim 10, wherein the third direction is substantially perpendicular to the fourth direction.

13. The mixer of claim 10, wherein the third direction is the same as the second direction and the fourth direction is the same as the first direction.

14. The mixer of claim 10, wherein the mixing component is rotationally symmetric about a center plane perpendicular to a longitudinal axis of the conduit.

15. The mixer of claim 10, wherein the first series of mixing elements comprises a plurality of baffles having a first configuration and a plurality of baffles having a second configuration arranged in an alternating manner, the first configuration being a mirror image of the second configuration about at least one center plan parallel to a longitudinal axis of the conduit.

16. The mixer of claim 15, wherein the baffles in the first series of mixing elements each include a first planar member oriented in the first direction and defining a leading edge, a second planar member oriented in the second direction and defining a trailing edge, a first deflecting surface extending outwardly from a first side of the first planar member and configured to direct fluid flow to a space adjacent a first side of the second planar member, and a second deflecting surface extending outwardly from a second side of the first planar member and configured to direct fluid flow to a space adjacent a second side of the second planar member.

17. The mixer of claim 16, wherein the leading edge is defined by a first section hooked toward the first side of the first planar member and a second section hooked toward the second side of the first planar member.

18. The mixer of claim 16, wherein the trailing edge is defined by a first section hooked toward the first side of the second planar member and a second section hooked toward the second side of the second planar member.

19. The mixer of claim 16, wherein the first series of mixing elements further comprises a partial baffle defining a first end of the mixing component, the partial baffle having first and second end surfaces aligned in a plane perpendicular to a longitudinal axis of the conduit and arranged in opposite corners of the mixing component.

20. The mixer of claim 19, wherein the second series of mixing elements is a mirror image of the first series of mixing elements about a center plane perpendicular to a longitudinal axis of the conduit.

21. The mixer of claim 10, wherein the mixing component further comprises:

first and second sidewalls defining opposite sides of the mixing component, the first series of mixing elements, second series of mixing elements, and a flow inversion baffle being disposed between the first and second sidewalls.

22. The mixer of claim 10, wherein the mixing component is integrally molded as a unitary structure.

* * * * *